United States Patent [19]

Nakahama

[11] Patent Number: 4,909,226

[45] Date of Patent: Mar. 20, 1990

[54] DEVICE DRIVING INJECTION PUMP FOR FUEL-INJECTION ENGINE

[75] Inventor: Ryoji Nakahama, Hamamatsu, Japan

[73] Assignee: Sanshin Kogyo Kabushiki Kaisha, Hamamatsu, Japan

[21] Appl. No.: 261,720

[22] Filed: Oct. 24, 1988

Related U.S. Application Data

[62] Division of Ser. No. 5,602, Jan. 21, 1987, Pat. No. 4,811,717.

[30] Foreign Application Priority Data

Feb. 12, 1986 [JP] Japan ..... 61-26893

[51] Int. Cl.[4] ..... F02M 39/00

[52] U.S. Cl. ..... 123/516; 123/509; 123/198 C

[58] Field of Search ..... 123/516, 514, 510, 512, 123/73 AD, 198 C, 509, 196 W

[56] References Cited

U.S. PATENT DOCUMENTS

| | | | |
|---|---|---|---|
| 4,480,602 | 11/1984 | Kobayashi | 123/73 AD |
| 4,499,884 | 2/1985 | Skinner | 123/516 |
| 4,557,235 | 12/1985 | Amemori | 123/196 W |
| 4,589,395 | 5/1986 | Timms | 123/516 |
| 4,615,305 | 10/1986 | Matsumoto | 123/73 AD |
| 4,625,694 | 12/1986 | Adey | 123/516 |
| 4,625,701 | 12/1986 | Bartlett | 123/516 |
| 4,811,717 | 3/1989 | Nakahama | 123/509 |

*Primary Examiner*—Carl Stuart Miller

*Attorney, Agent, or Firm*—Ernest A. Beutler

[57] ABSTRACT

Several embodiments of outboard motors having fuel injected internal combustion engines. In each embodiment, the fuel injection pump is disposed so that its drive shaft extends horizontally and so that its outlets for pressurized fuel are below its top end to avoid the inclusion of air in the fuel. In each embodiment, the fuel injection pump has an air vent that is vented back to a remotely positioned fuel tank.

11 Claims, 6 Drawing Sheets

DEVICE DRIVING INJECTION PUMP FOR FUEL-INJECTION ENGINE

This is a division of U.S. patent application Ser. No. 005,602, filed Jan. 21, 1987, now U.S. Pat. No. 4,811,717.

BACKGROUND OF THE INVENTION

This invention relates to a drive for driving the injection pump for a fuel injected internal combustion engine and more particularly to an improved fuel injection pump arrangement for internal combustion engines.

Many forms of internal combustion engines now employ high pressure fuel injection pumps for spraying fuel into either the combustion chambers of the engine, as in the case of diesel or some gasoline engines, or for spraying fuel into the intake ports of the engine. Of course, the amount of fuel injected is extremely critical to engine operation and many times the engine is shut off and then restarted. If air is permitted to leak into the system and if the system is disposed in such a way that this air forms a trap between the fuel injection pump and the discharge nozzle, poor running or the impossibility of starting may result. These problems are particularly acute if the injection pump is oriented in such a way that its discharge nozzles are vertically positioned, i.e., at the highest vertical position of the fuel injection pump.

One type of engine in which fuel injection is utilized is an outboard motor. In an outboard motor, the engine normally operates in an orientation which is different from conventional engines. That is, in an outboard motor, the engine normally operates with its output shaft rotating about a vertically extending rather than a horizontally extending axis. This orientation of the engine gives rise to particular problems in connection with fuel injection systems.

In addition to the air lock problem described above, when a fuel injection pump is oriented vertically in an engine that has its output shaft also extending in a vertical direction, the piping from the fuel injection pump to the fuel injection nozzles become complicated. In addition, this type of orientation causes different lengths of distribution pipes running from the fuel injection pump to the fuel injection nozzles and this can result in unequal fuel distribution between the various cylinders of the engine.

In addition to the aforenoted problems, the provision of a vertically extending fuel injection pump coupled with an engine that has its output shaft rotating about a vertically extending axis gives rise to space problems, which are particularly acute in connection with outboard motors. That is, the driving arrangement for such a disposed fuel injection pump can either cause lengthening of the engine or at least lengthening of at least certain components of it such as the output shaft. In addition to requiring additional space, such vertical lengthening of the engine gives rise to an increased height which can undesirably offset the center of balance of the engine.

Furthermore, the vertical positioning of the fuel injection pump tends to cause the engine to become bulky even if it is not lengthened. That is, it is difficult to provide a compact internal combustion engine when the fuel injection pump extends along an axis that is parallel to the crankshaft axis and in which the engine is disposed vertically.

It is, therefore, a principal object of this invention to provide an improved fuel injection system for an internal combustion engine.

It is a further object of this invention to provide a fuel injection system for an internal combustion engine wherein the likelihood of air locks is minimized or substantially reduced.

It is a further object of this invention to provide an improved system for purging air from a fuel injection pump during its operation.

It is yet another object of this invention to provide a compact driving arrangement for the fuel injection pump of an internal combustion engine.

It is yet another object of this invention to provide an improved and compact arrangement for a fuel injection pump and its associated internal combustion engine.

SUMMARY OF THE INVENTION

A first feature of this invention is adapted to be embodied in a fuel injection system for an internal combustion engine having a vertically extending output shaft axis. A fuel injection pump is provided with a drive shaft and means are provided for driving the fuel injection pump drive shaft from the engine output shaft. In accordance with this feature of the invention, the fuel injection pump drive shaft rotates about a horizontally extending axis.

Another feature of this invention is adapted to be embodied in a fuel injection system for an internal combustion engine having an output shaft, a fuel injection pump having a drive shaft and means for driving the fuel injection pump drive shaft from the engine output shaft. In accordance with this feature of the invention, the fuel injection pump is disposed with its outlet disposed vertically below the top of the fuel injection pump.

Yet another feature of the invention is adapted to be embodied in a fuel injection system for an internal combustion engine having an output shaft, a fuel injection pump having a drive shaft and means for driving the fuel injection pump drive shaft from the engine output shaft. In accordance with this feature of the invention, means are provided for venting the air from the interior of the fuel injection pump.

Yet another feature of the invention is adapted to be embodied in a fuel injection system for an internal combustion engine having an output shaft, a fuel injection pump having a drive shaft and means for driving the fuel injection pump drive shaft from the engine output shaft. The engine is provided with two aligned cylinders that define a recess between them. In accordance with this feature of the invention, the fuel injection pump is disposed within the recess between the cylinders.

DETAILED DESCRIPTION OF THE PREFERRED EMBODIMENTS

Figure 1:
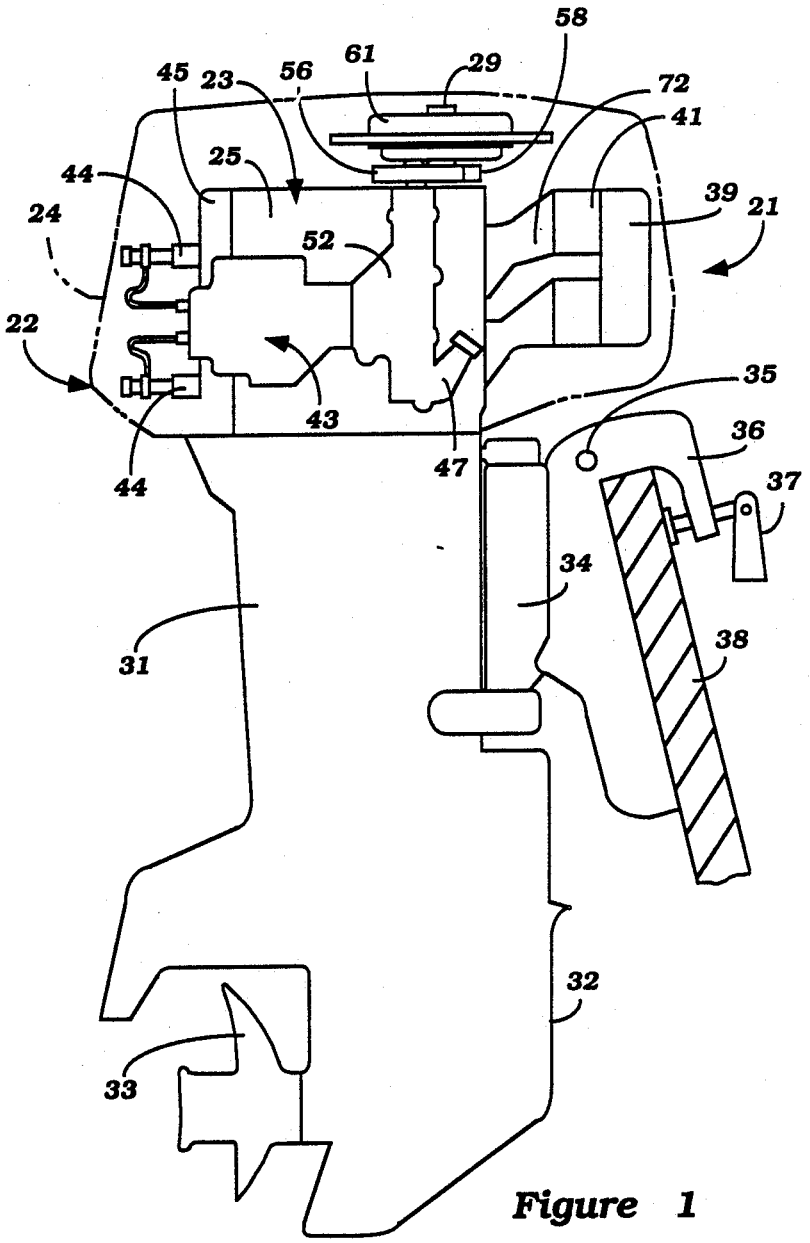
FIG. 1 is a side elevational view of an outboard motor constructed in accordance with a first embodiment of the invention, with portions shown in phantom and other portions shown in cross-section.

Referring first to the embodiment of FIGS. 1 through 7, an outboard motor constructed in accordance with this embodiment is identified generally by the reference numeral 21. The invention is described in conjunction with an outboard motor since the internal combustion engines of outboard motors normally have their output shafts rotating about a vertically extending axis and thus present certain of the problems described in the section under the heading "Background Of The Invention". It is to be understood, however, that certain features of the invention may be utilized with applications other than outboard motors and, in fact, in some instances, with internal combustion engines which have their output shafts rotating about horizontally extending axes.

The outboard motor 21 includes a power head, indicated generally by the reference numeral 22, and which is comprised of an internal combustion engine 23 and a surrounding protective cowling, shown in phantom and identified by the reference numeral 24. In the illustrated embodiment, the engine 23 is of the two cylinder, inline, crankcase compression diesel type. It is to be understood, however, that the invention may be utilized in conjunction with engines having other numbers of cylinders and engines other than those operating on the diesel principle. However, certain facets of the invention have particular utility in connection with inline type of engines and/or diesel type of engines.

The engine 23 includes a cylinder block 25 in which cylinder bores 26 (FIG. 3) are formed. Pistons 27 reciprocate within the cylinder bores 26 and are connected by means of connecting rods 28 to a crankshaft 29 which, as aforenoted, rotates about a vertically extending axis.

The crankshaft 29 is rotatably coupled in a known manner to a drive shaft (not shown) that is journaled within a drive shaft housing 31. A lower unit 32 is attached to the lower end of the drive shaft housing 31 and journals a propeller shaft (not shown) that is driven by the drive shaft through a forward, neutral, reverse transmission of a known type for driving a propeller 33.

A steering shaft (not shown) is fixed to the drive shaft housing 31 and is journaled within a swivel bracket 34 for steering movement of the outboard motor 21 about a vertically extending steering axis defined by the steering shaft. The swivel bracket 34 is, in turn, pivotally connected by means of a pivot pin 35 to a clamping bracket 36. As a result of this pivotal connection, the outboard motor 21 may be tilted relative to the clamping bracket 36 for either trim adjustment or to permit the outboard motor 21 to be tilted up to an elevated, out of the water position. The clamping bracket 36 includes clamping means 37 for attachment to a transom 38 of an associated watercraft.

The construction of the outboard motor 21 as thus far described may be considered to be conventional. Since the invention relates to a fuel injection system for the engine 23, rather than any specific detail of the outboard motor 21, further description of those components of the outboard motor 21 which have no bearing on the invention is believed to be unnecessary.

Figure 2:
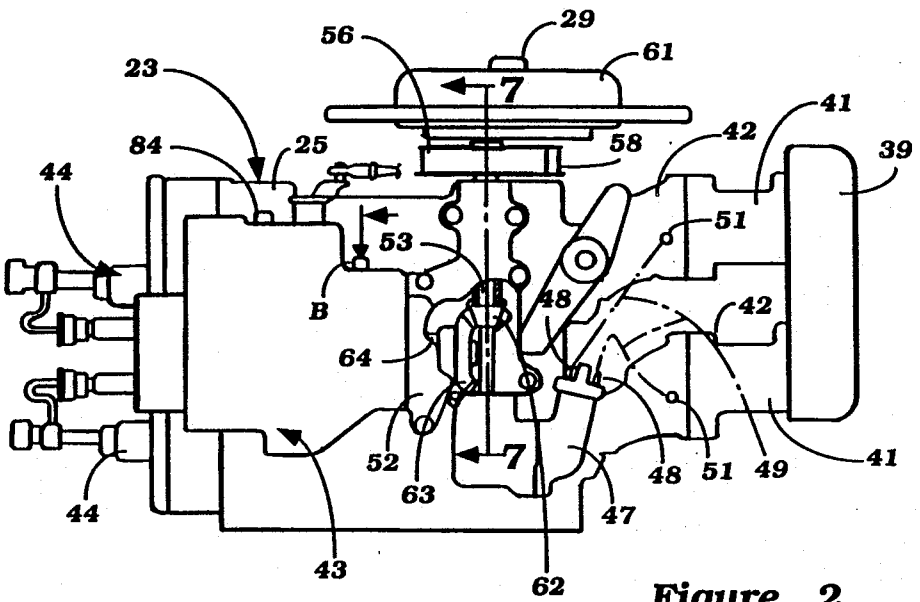
FIG. 2 is an enlarged side elevational view of the engine of the outboard motor, with a portion broken away.
Figure 3:
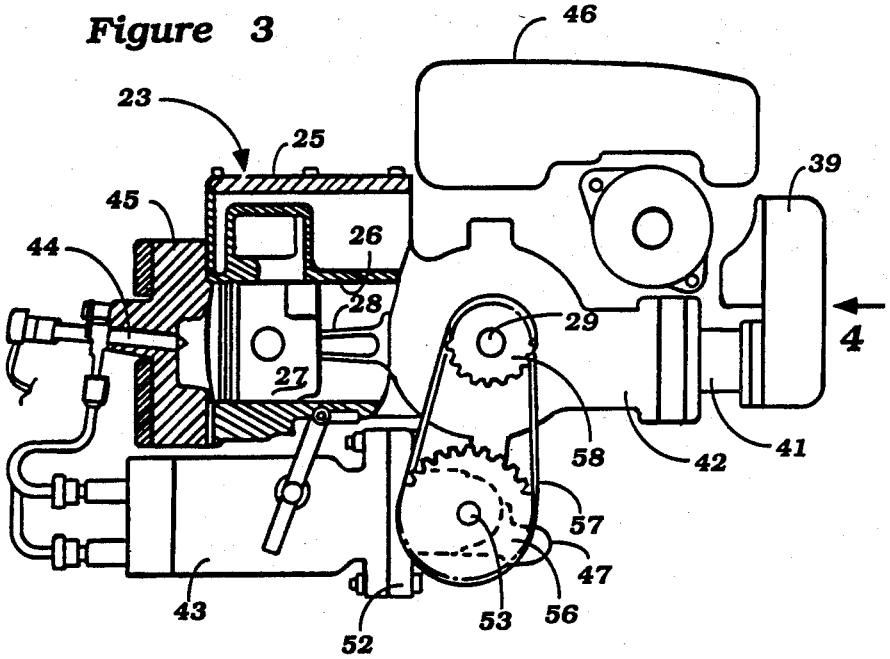
FIG. 3 is a top plan view of the engine with further portions broken away.
Figure 4:
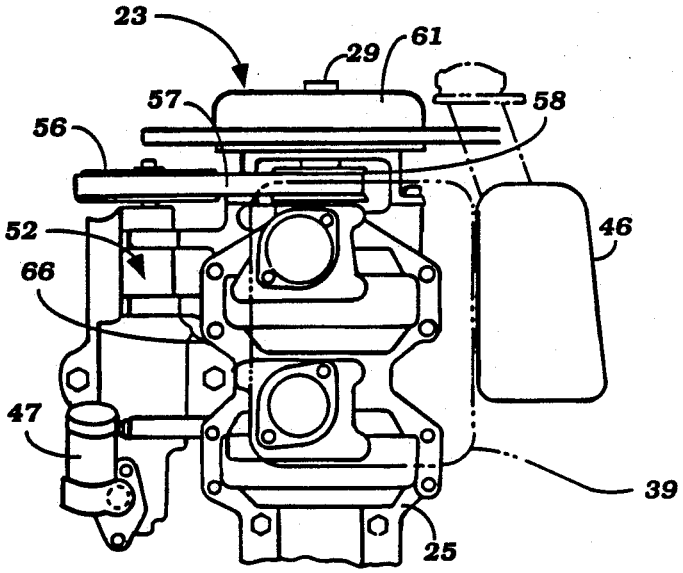
FIG. 4 is an end elevational view looking in the direction of the arrow 4 in FIG. 3, with the air silencer removed.

Referring now primarily to FIGS. 2 through 4, the engine 23 is provided with an air induction system including an air silencer 39 which draws intake air from within the protective cowling 24. The air is admitted to the interior of the protective cowling 24 through any known form of atmospheric air inlet. A pair of throttle bodies 41 in which throttle valves (not shown) are journaled receive air from the air silencer 39 and delivers this air to individual sealed crankcase chambers of the engine 23 through respective intake manifolds 42. Reed type check valves (not shown) may be positioned in the manfiolds 42 so as to prevent reverse flow through them and through the throttle bodies 41.

The engine 23 is provided with a fuel injection system including an injection pump, indicated generally by the reference numeral 43. The fuel injection pump 43 delivers fuel to injection nozzles 44 that are supported within a cylinder head 45 that is affixed in a known manner to the cylinder block 25 for closing the cylinder bores 26. The injection pump 43 is designed so as to deliver high pressure fuel to the nozzles 44 in an amount and at a timing so as to initiate combustion in the combustion chambers.

The engine 23 is also provided with a positive lubricating system that includes a lubricant tank 46 that is contained within the protective cowling 24 and which is designed so as to contain or hold a predetermined quantity of lubricant. Lubricant is transferred from the tank 46 to a lubricant pump 47 through a suitable conduit (not shown). The lubricant pump 47 delivers lubricant to the components of the engine to be lubricated. For example, the lubricant pump 47 may include a pair of discharge outlets 48 that discharge to the intake manifolds 42 through conduits 49 and nozzles 51. Alternatively, lubricant may be delivered directly to certain of the components of the engine to be lubricated or the engine may be lubricated through a combination of these systems.

In accordance with the invention, an arrangement is provided for driving the fuel injection pump 43 and lubricant pump 47 which includes a transfer drive 52. As may be best seen from FIG. 7, the transfer drive 52 includes a drive shaft 53 that is journaled in a transfer drive housing 54 by means of spaced apart bearings 55. A pulley 56 is carried at the exposed upper end of the transfer drive shaft 53 and is driven by means of a belt 57 from a pulley 58 that is affixed to the engine output shaft 29 immediately adjacent its flywheel magneto 61.

A bevel gear 62 is affixed to the transfer drive shaft 53 adjacent its midpoint. The bevel gear 62 meshes with a bevel gear 63 which is, in turn, affixed to a fuel pump drive shaft 64.

Figure 5:
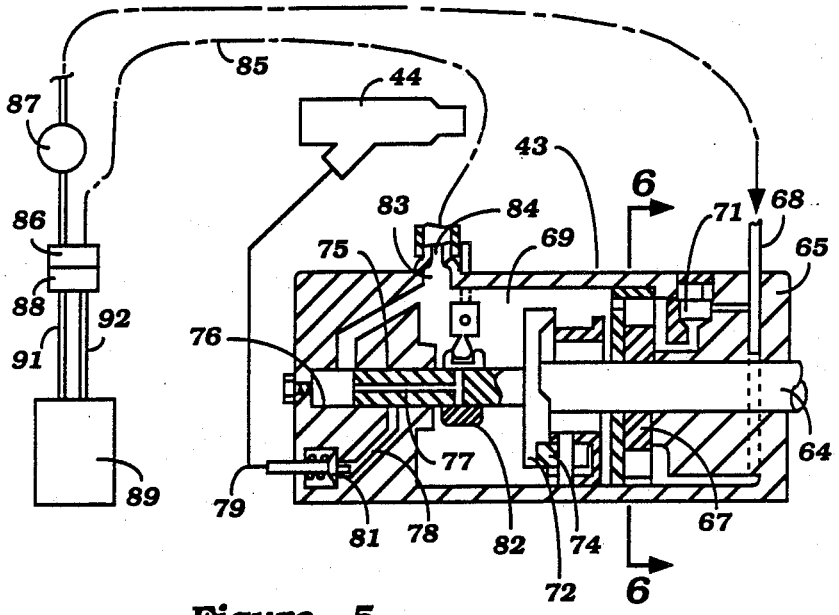
FIG. 5 is an enlarged cross-sectional view of the fuel injection pump and schematically shows its association with a remotely positioned fuel tank.
Figure 6:
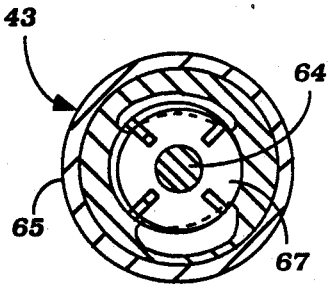
FIG. 6 is a cross-sectional view taken along the line 6—6 of FIG. 5.
Figure 7:
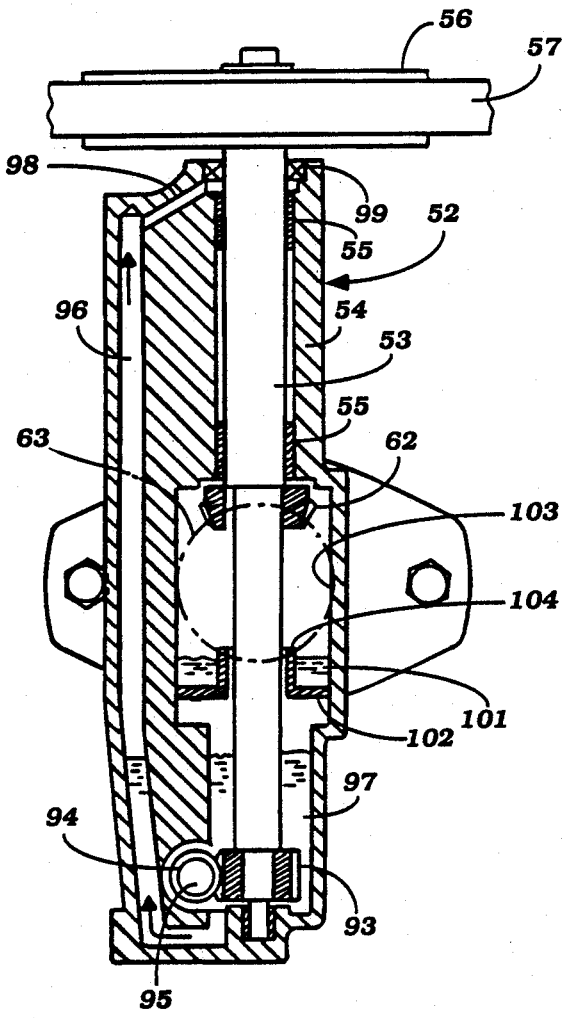
FIG. 7 is an enlarged cross-sectional view taken along the line 7—7 of FIG. 2.

As may be seen in FIGS. 5 and 6, the fuel pump drive shaft 64 extends through an outer housing 65 of the fuel injection pump 43. The housing 65 is conveniently affixed to a flange formed on the outer housing 54 of the transfer drive 52. As may be best seen in FIG. 4, the cylinder block 25 is formed with a recess 66 between the adjacent cylinder bores 26 and the fuel injection pump housing 65 extends into this recess with the fuel injection pump drive shaft 64 rotating about a horizontally disposed axis. As a result, it is possible to maintain a very low configuration for the assembly.

A vane carrier 67 of a vane type pump is affixed to the fuel pump drive shaft 64 within a pumping cavity formed at the end of the fuel injection pump housing 65 adjacent to the transfer drive 52. This high pressure pump receives fuel from a remotely positioned fuel tank (to be described) through a conduit 68 and discharges the high pressure fuel into a chamber 69 of the housing 65 which chamber is positioned adjacent the vane carrier 67. A pressure relief valve 71 is provided for limiting the maximum pressure existent in the chamber 69 and outputted by the high pressure pump.

Affixed for rotation with the shaft 64 but axially movable relative to it is a cam disk 72 which cooperates with a roller 74 for effecting reciprocation of the cam disk 72 and a piston 75 that is slidably supported within a bore 76 of the fuel injection pump housing 64 and which rotates with the shaft 64. A delivery passage 77 extends through the piston 75 and has an outlet port (not shown) that communicates with delivery passages 78 that deliver high pressure fuel to a respective conduit 79 through a delivery valve 81. The conduits 79 extend to the respective fuel injection nozzles 44 for delivering a timed charge of fuel to the combustion chamber. A slidably supported spill ring 82 is controlled by the operator throttle for controlling the amount of fuel that is discharged in response to operator demand, as is well known in this art.

As has been previously noted, conventional engines as operated with their output shafts rotating about a vertically extending axis, as with outboard motors, also employ fuel injection pumps where the drive shaft 64 rotates about a vertically extending axis rather than horizontally as in accordance with this invention. With a vertical arrangement, it should be readily apparent that any air in the system can be trapped in the bore 76 and would, accordingly, adversely affect the operation of the engine. In fact, if air becomes entrained in this area when the engine is shut down, it may be difficult if not impossible to restart the engine. Also, the delivery valves 81 are also at the top of the chamber under such conditions and they also can be entrapped with air.

However, in view of the horizontal placement of the fuel injection pump 43, these disadvantages are avoided. Furthermore, there is provided an air chamber 83 at the highest portion of the housing 65 in communication with the cavity 69. The air chamber 83 communicates with a vent fitting 48 which may be vented to a conduit 85. The conduit 85 and the fuel supply conduit 68 extend to a common quick disconnect fitting 86 which is conveniently located in the outer cowling of the power head 22. A further engine driven fuel pump 87 of any known type may be positioned in the fuel conduit 68 for delivering pressurized fuel to the fuel injection pump 43.

A cooperating fitting 88 is attached to the fitting 86 and is connected to a fuel tank 89 which may be remotely positioned, for example, in the hull of the watercraft. A fuel line 91 and vent line 92 extend from the tank 89 to the quick disconnect fitting 88 so as to complete the fuel and air venting circuitry.

Referring again to FIG. 7, it will be noted that the lubricant pump 47 is also driven by the transfer drive 52. To this end, there is provided a worm wheel 93 which is affixed to the lower end of the drive shaft 53 and which meshes with a worm 94 that is affixed to a lubricant pump drive shaft 95. The drive shaft 95 drives the lubricant pump 47 in a known manner.

An arrangement is incorporated for lubricating the shaft 53, bevel gears 62 and 63 of the transfer drive 52. This lubricating system includes a passage 96 that extends from a lubricant reservoir 97 formed at the lower end of the transfer drive housing 54 to a passage 98 which intersects the housing 52 and specifically the bore in which the shaft 53 in journaled above the uppermost bearing 55. An oil seal 99 is positioned above this point of intersection.

The configuration of the worm 94 is such that lubricant will be forced from the reservoir 97 up through the passage 96 and across the passage 98 in the direction shown by the arrows so as to lubricate the uppermost bearing 55. The lubricant can then travel downwardly along the shaft 53 by gravity to lubricate the bearing 55 and to fall on the backside of the bevel gear 62. The lubricant is then slung outwardly into a second lubricant reservoir 101 that is formed by a wall 102 that is pressed into a counterbore 103 of the housing 54. The wall 102 has an upper edge 104 that determines the upper end of the lubricant reservoir 101. It should be noted that this point is below the lower peripheral edge of the bevel gear 63 so that the bevel gear 63 will be partially submerged in the reservoir 101 and be lubricated by the lubricant therein. In addition, this lubricant will be carried to the gear 62 so as to lubricate it.

Figure 8:
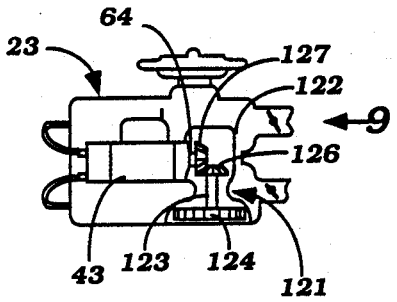
FIG. 8 is a side elevational view of an internal combustion engine constructed in accordance with another embodiment of the invention, in part similar to FIG. 2, but on a smaller scale.
Figure 9:
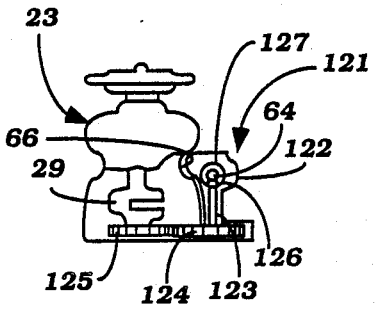
FIG. 9 is an end elevational view, with portions removed and other portions broken away, taken in the direction of the arrow 9 in FIG. 8.

FIGS. 8 and 9 show another embodiment of the invention that is substantially the same as FIGS. 1 through 7. The only difference between the embodiment of FIGS. 8 and 9 and the embodiment of FIGS. 1 through 7 is the manner in which the fuel injection pump 43 is driven and for that reason only that portion of the assembly is shown in detail and will be described. Any elements not described in conjunction with this embodiment may be assumed to the same as the previously described embodiment. Also, since the only difference is the manner in which the fuel injection pump 43 is driven, only that portion of the outboard motor is illustrated.

Referring now in detail to FIGS. 8 and 9, a transfer drive for driving the fuel injection pump 43 is indicated generally by the reference numeral 121. In this embodiment, the transfer drive 121 includes an outer housing 122 in which a drive shaft 123 is journaled in a suitable manner. A driven gear 124 is affixed to the lower end of the drive shaft 123 and meshes with a driving gear 125 that is affixed to the lower end of the engine crankshaft 29.

A bevel gear 126 is affixed to the upper end of the drive shaft 123 and meshes with a bevel gear 127 that is affixed to the fuel injection pump drive shaft 64. As in the previously described embodiment, the fuel injection pump drive shaft 64 is disposed horizontally and the fuel injection pump 43 is disposed in a recess 66 of the cylinder block so as to provide a compact arrangement.

Figure 10:
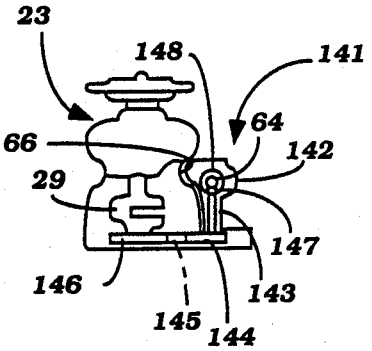
FIG. 10 is an elevational view, in part similar to FIG. 9, showing another embodiment of the invention.

Yet another embodiment of the invention is shown in FIG. 10. Like the embodiment of FIGS. 8 and 9, this embodiment differs from the embodiment of FIGS. 1 through 7 only in the construction of the transfer drive for driving the fuel injection pump 47 and for that reason only this portion of the assembly will be described. Referring specifically to this figure, the transfer drive is indicated generally by the reference numeral 141. The transfer drive 141 includes an outer housing 142 in which a drive shaft 143 is supported for rotation in any suitable manner.

A pulley 144 is affixed to the lower end of the drive shaft 143 and is driven by a belt 145 from a pulley 146 that is affixed to the lower end of the engine crankshaft 29.

A bevel gear 147 is affixed to the upper end of the drive shaft 143 and drives a bevel gear 148. The bevel gear 148 is affixed for rotation with the fuel injection pump drive shaft 64 which, like in the previously described embodiments, extends horizontally. Again, the fuel injection pump 43 is disposed in the recess 66 formed between the cylinder bores of the cylinder block.

It should be readily apparent from the foregoing description that several embodiments of highly effective arrangements for driving a fuel injection pump from a vertically positioned engine output shaft have been illustrated and described. In each embodiment, the fuel supply conduits for the multiple cylinders of the injected engine may be conveniently formed and may easily be made of the same length. In addition, an arrangement has been described for venting air from the fuel injection pump back to a remotely positioned fuel tank. Because of the horizontal disposition of the fuel injection pump and specifically its drive shaft, the likelihood of air becoming entrapped in the system and interferring with the fuel flow is substantially reduced.

Although a number of embodiments of the invention have been illustrated and described, various changes and modifications may be made without departing from the spirit and scope of the invention, as defined by the appended claims.

I claim:

1. In a fuel injection system for an outboard motor supported for tilt and trim movement about a horizontally extending axis and an internal combustion engine having an output shaft, a fuel injection pump having a drive shaft, and means for driving said fuel injection pump drive shaft from said engine output, the improvement comprising said fuel injection pump having a housing defining an internal cavity adapted to contain fuel, a fuel injection nozzle discharge extending from a point below the vertical uppermost edge of said cavity for delivering fuel to said fuel injection nozzle without the inclusion of air therein in all trim conditions of said outboard motor.

2. In a fuel injection system as set forth in claim 1 further including a remotely positioned fuel tank and means including a quick disconnect coupling for connecting said remotely positioned fuel tank to the fuel injection pump inlet.

3. In a fuel injection system as set forth in claim 2 wherein the fuel injection pump cavity air vent is vented back to the remotely positioned fuel tank.

4. In a fuel injection system as set forth in claim 3 wherein the air venting to the remotely positioned fuel tank is through a quick disconnect coupling.

5. In a fuel injection system as set forth in claim 4 wherein the disconnect couplings of the fuel conduit and the air vent are in a common fitting.

6. In a fuel injection system for an outboard motor supported for tilt and trim movement about a horizontally extending axis and an internal combustion engine having an output shaft, a fuel injection pump having a drive shaft, and means for driving said drive shaft from said engine output shaft, the improvement comprising said fuel injection pump having its outlet disposed vertically below the top of said fuel injection pump in all trim conditions of said outboard motor.

7. In a fuel injection system as set forth in claim 6 wherein the fuel outlet of the fuel injection pump is fed from a chamber defined within a fuel injection pump housing and the outlet is disposed at a lower end of said chamber.

8. In a fuel injection system as set forth in claim 7 further including an air vent formed in the top of said member.

9. In a fuel injection system as set forth in claim 8 further including a remotely positioned fuel tank and means including a quick disconnect coupling for connecting said remotely positioned fuel tank to the fuel injection pump inlet.

10. In a fuel injection system as set forth in claim 9 wherein the fuel injection pump cavity air vent is vented back to the remotely positioned fuel tank.

11. In a fuel injection system as set forth in claim 10 wherein the air venting to the remotely positioned fuel tank is through a quick disconnect coupling.

* * * * *

UNITED STATES PATENT AND TRADEMARK OFFICE

CERTIFICATE OF CORRECTION

PATENT NO. : 4,909,226

DATED : March 20, 1990

INVENTOR(S) : Ryoji Nakahama

It is certified that error appears in the above-identified patent and that said Letters Patent is hereby corrected as shown below:

Column 8, line 34, Claim 8, "member" should be --chamber--.

Signed and Sealed this

Third Day of November, 1992

*Attest:*

DOUGLAS B. COMER

*Attesting Officer*

*Acting Commissioner of Patents and Trademarks*